US007905522B1

(12) United States Patent
Picard

(10) Patent No.: US 7,905,522 B1
(45) Date of Patent: Mar. 15, 2011

(54) EXIT PUSHBAR WITH BLOCKING MECHANISM

(75) Inventor: Daniel J. Picard, Watertown, CT (US)

(73) Assignee: Sargent Manufacturing Company, New Haven, CT (US)

( * ) Notice: Subject to any disclaimer, the term of this patent is extended or adjusted under 35 U.S.C. 154(b) by 412 days.

(21) Appl. No.: 11/531,923

(22) Filed: Sep. 14, 2006

(51) Int. Cl.
*E05B 65/10* (2006.01)
*E05B 65/00* (2006.01)

(52) U.S. Cl. ..... 292/92; 292/93; 292/94; 292/DIG. 65

(58) Field of Classification Search ..... 292/92–94, 292/DIG. 65
See application file for complete search history.

(56) References Cited

U.S. PATENT DOCUMENTS

| | | | | | |
|---|---|---|---|---|---|
| 3,073,142 | A | * | 1/1963 | Stebbins | 70/92 |
| 3,663,047 | A | * | 5/1972 | Zawadzki | 292/92 |
| 3,719,248 | A | * | 3/1973 | Breitschwerdt et al. | 180/271 |
| 4,083,590 | A | * | 4/1978 | Folger | 292/92 |
| 4,167,280 | A | * | 9/1979 | Godec et al. | 292/92 |
| 4,384,738 | A | | 5/1983 | Floyd | |
| 4,429,909 | A | * | 2/1984 | Lindquist | 292/92 |
| D279,647 | S | | 7/1985 | Ohno | |
| 4,627,649 | A | * | 12/1986 | Leplat | 292/92 |
| 4,714,282 | A | | 12/1987 | Henderson | |
| 4,906,034 | A | * | 3/1990 | Verslycken | 292/92 |
| 5,011,199 | A | * | 4/1991 | Lowe et al. | 292/92 |
| 5,085,475 | A | * | 2/1992 | Austin et al. | 292/92 |
| 5,169,185 | A | * | 12/1992 | Slaybaugh et al. | 292/92 |
| 5,340,171 | A | * | 8/1994 | Slaybuagh et al. | 292/21 |
| 5,531,492 | A | | 7/1996 | Raskevicius | |
| 5,570,914 | A | | 11/1996 | Hughes | |
| 5,669,642 | A | * | 9/1997 | Kang | 292/336.3 |
| 6,042,159 | A | * | 3/2000 | Spitzley et al. | 292/216 |
| 6,048,000 | A | | 4/2000 | Geringer et al. | |
| 6,120,071 | A | | 9/2000 | Picard et al. | |
| 6,174,004 | B1 | | 1/2001 | Picard et al. | |
| 6,409,232 | B1 | | 6/2002 | Nigro, Jr. et al. | |
| 6,471,262 | B1 | * | 10/2002 | Schwab | 292/336.3 |
| 6,622,534 | B1 | * | 9/2003 | Miller et al. | 70/92 |
| 6,709,033 | B2 | * | 3/2004 | Jooss et al. | 292/336.3 |
| 6,802,550 | B1 | | 10/2004 | Griggs, Jr. et al. | |
| 6,971,688 | B2 | | 12/2005 | Drysdale et al. | |
| 7,029,042 | B2 | * | 4/2006 | Belchine, III | 292/336.3 |

* cited by examiner

*Primary Examiner* — Carlos Lugo
(74) *Attorney, Agent, or Firm* — DeLio & Peterson, LLC

(57) ABSTRACT

An exit device for latching a door in tornado-prone areas keeps the door closed when the door is subjected to tornado debris impact by incorporating a blocking arm that swings outward away from the door as impact energy is transferred through the door to the blocking arm in the exit device. The blocking arm prevents a pushbar actuator from moving towards the door during impact or rebound which would allow the door to open. The blocking arm is biased close to the door in a non-blocking position where it initially receives the transferred impact energy. During the impact event the blocking arm rapidly rotates on a pivot from the non-blocking position to a blocking position away from the door. After the impact event, the blocking arm returns to the non-blocking position so that the exit device operates normally.

9 Claims, 3 Drawing Sheets

EXIT PUSHBAR WITH BLOCKING MECHANISM

BACKGROUND OF THE INVENTION

1. Field of the Invention

This invention relates generally to exit devices that secure a door in the closed position. More specifically, the present invention relates to exit devices that keep a door closed when subjected to a high-energy impact as may occur when debris is hurled by a tornado against the door.

2. Description of Related Art

An "exit device" is a lock mechanism operated from the inside of an exit door through the use of a crossbar, pushbar, pushrail or panic bar actuator. The term "pushbar" will be used herein to refer to the above types of exit device actuators and other types of actuators including paddles and various other mechanisms that move towards the exit door to actuate the latch. The exit device is designed to open the exit door, allowing exit without prior knowledge of how the lock operates, whenever a horizontal force is applied to the pushbar actuator. Exit devices are typically required by fire or building codes and are used in public buildings where many people may be gathered, to provide rapid, safe and easy egress in case of emergency.

Exit devices of this general type may be seen in U.S. Pat. Nos. 4,384,738; 5,531,492 and U.S. Design Pat. No. 279,647 all of which are assigned to Sargent Manufacturing Company, the assignee of the present patent application.

Conventional exit devices typically include a mounting rail that is mounted on the interior surface of the exit door and a pushbar actuator that is mounted so that it can move towards the mounting rail to operate the exit device. The pushbar actuator is spring biased away from the exit door. When horizontal pressure is applied to the pushbar, it moves horizontally in towards the mounting rail, compresses the bias springs and retracts a latchbolt to open the exit door.

In a tornado rated exit device, the exit device must keep the exit door closed when subjected to a high-energy impact on the exterior surface of the door. The test to provide a tornado rating involves loading a cannon with a long 2"×4" board of the type used in construction and firing it at a speed of one hundred miles per hour (160 kilometers per hour) into the exterior side of the exit door. The exit device must keep the exit door closed, and remain operable after the impact.

Conventional exit devices are unable to pass this test because the high-energy impact on the exterior side of the door pushes the mounting rail and the exit door towards the pushbar. The impact energy is so high that the door and mounting rail rapidly move towards the pushbar actuator, while the pushbar remains stationary due to inertia. As the door and mounting rail move towards the pushbar, the biasing springs that hold the pushbar away from the exit door are compressed and the door opens.

The exit device may also fail this test if the pushbar rebounds towards the exit door during dissipation of the impact energy. In both cases, the pushbar and the mounting rail move towards each other as a result of the high-energy impact. This relative motion compresses the bias springs and retracts the latchbolt exactly as if the pushbar had been pushed towards the mounting rail to operate the exit device in the normal manner.

The prior art has addressed this problem by increasing the strength of the bias springs that hold the pushbar away from the support rail. The increased spring strength prevents the pushbar from moving towards the mounting rail during the impact. While this is effective, it means that every time the door is operated the user must apply sufficient force to compress the stronger bias springs. This higher level of required force for normal operation is an undesirable characteristic for an exit device and makes it difficult to operate for the elderly and other users.

Bearing in mind the problems and deficiencies of the prior art, it is therefore an object of the present invention to provide an exit device that operates with a normal level of force and which automatically blocks operation during a high energy impact, but which thereafter releases the blocking so that the exit device operates normally.

Still other objects and advantages of the invention will in part be obvious and will in part be apparent from the specification.

SUMMARY OF THE INVENTION

The above and other objects, which will be apparent to those skilled in the art, are achieved in the present invention which is directed to an exit device including a latch, a mounting rail and a pushbar mounted for motion relative to the mounting rail between an inward position towards the mounting rail and an outward position away from the mounting rail. The pushbar operates the latch when moved to the inward position. At least one biasing spring acts to bias the pushbar towards the outward position.

The exit device further includes a blocking arm connected to the mounting rail and movable between a blocking position and a non-blocking position. The blocking arm is biased towards the non-blocking position and into contact with the mounting rail where it can receive transferred impact energy. The blocking arm moves outwards and away from the mounting rail into the blocking position to prevent motion of the pushbar towards the mounting rail during a high-energy impact against the door.

In one aspect of the invention the exit device further includes a pivot and a blocking arm spring, the pivot connecting the blocking arm to the mounting rail and the blocking arm spring acting to bias the blocking arm towards the non-blocking position into contact with the mounting rail where it may receive the transferred impact energy through the door and the mounting rail.

The blocking arm spring provides a biasing force that is sufficiently strong to hold the blocking arm in contact with the mounting rail in the non-blocking position before the high-energy impact, and sufficiently weak to allow the blocking arm to move to the blocking position away from the mounting rail during the high-energy impact against the door.

In another aspect of the invention, the exit device further includes a pair of connecting arms forming a parallelogram linkage with the pushbar and the mounting rail, and the blocking arm contacts at least one of the connecting arms to prevent inward motion of the pushbar when the blocking arm is in the blocking position.

The blocking arm pivot is preferably substantially vertical and the blocking arm preferably moves substantially horizontally between the non-blocking and the blocking positions. The high-energy impact against the door defines an impact direction and the blocking arm in the most highly preferred embodiment moves in the same direction as the impact direction when moving from the non-blocking position to the blocking position.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1-3 of the drawings in which like numerals refer to like features of the invention.

Figure 1:
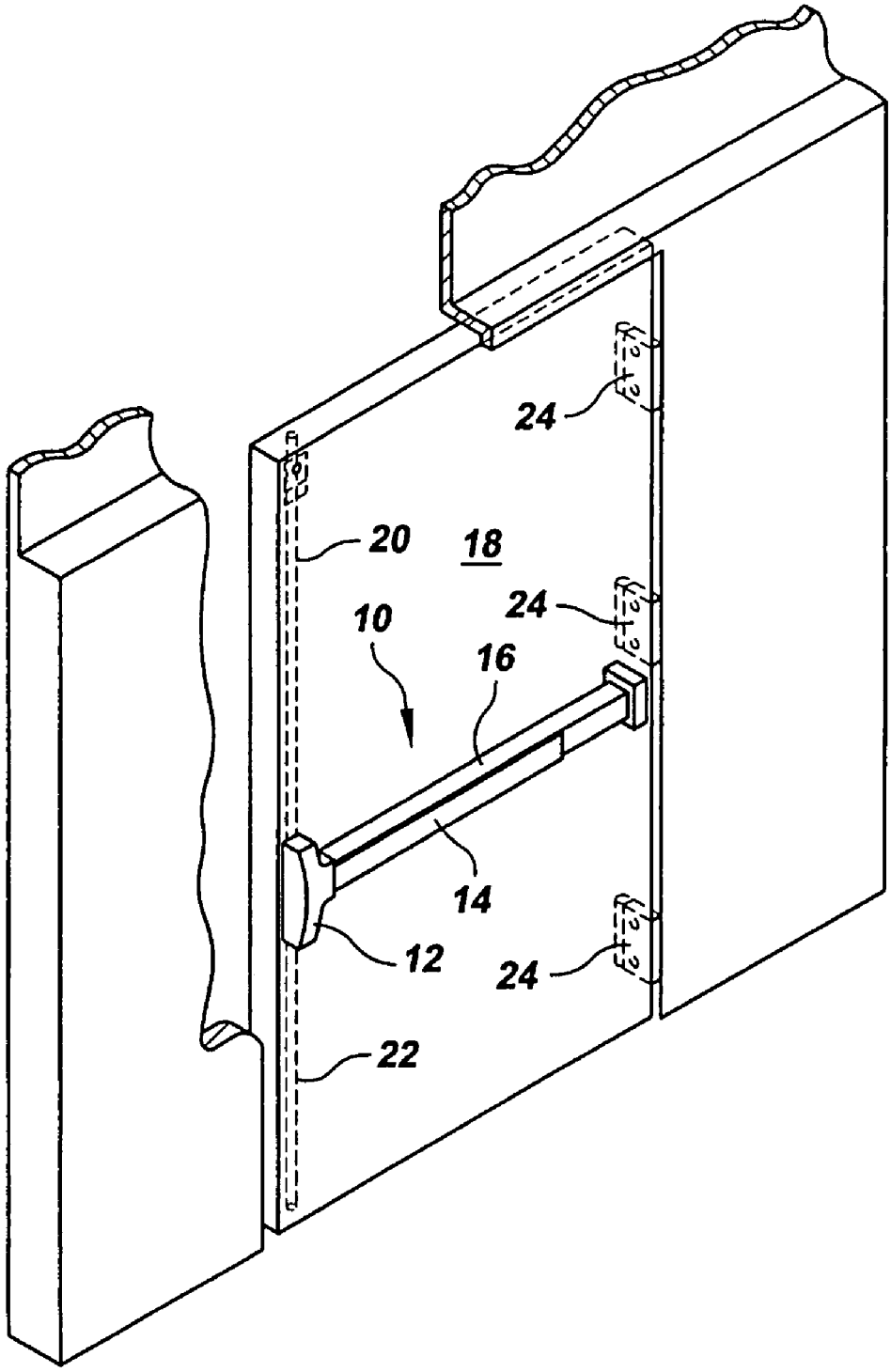
FIG. 1 is a perspective view showing an exit device incorporating the present invention, the exit device including a latch mechanism, a mounting rail and a pushbar. The exit device is shown installed on an exit door and uses a vertical rod latch mechanism, the vertical rods being hidden inside the exit door and drawn in phantom.

FIG. 1 shows an exit device 10 suitable for use in tornado-prone areas. The exit device 10 includes a latch mechanism 12, a pushbar 14 and a mounting rail 16 mounted on an exit door 18. The latch mechanism 12 that is illustrated is a vertical rod latch mechanism incorporating hidden vertical rods 20, 22 located inside the exit door 18. Other latch mechanisms are also suitable, including designs that have a conventional latchbolt that extends out of the latch mechanism 12 and into a strike on the adjacent doorframe.

The exit device 10 is conventionally operated to open the door by applying pressure to the pushbar 14. The pushbar 14 is spring biased away from the exit door 18 and the mounting rail 16. When pressure is applied horizontally (approximately perpendicular to the face of the door) to the pushbar 14, the pushbar moves inwards towards the exit door 18 and the mounting rail 16 to operate the latch 12 and retract the vertical rods 20, 22. The exit door 18 can then swing open on hinges 24.

Figure 2:
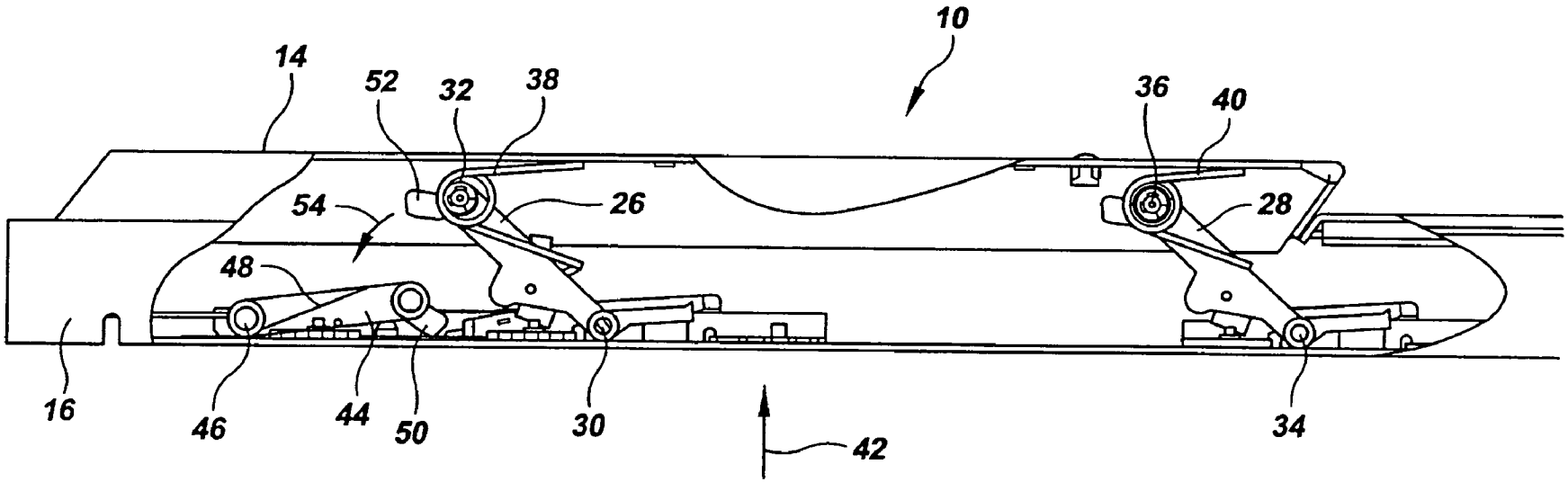
FIG. 2 is a partial view of the mounting rail and pushbar portions of the exit device seen in FIG. 1 looking upward from the bottom of FIG. 1 with portions of the mounting rail and pushbar being cut away to show the blocking mechanism of the present invention. The blocking mechanism is shown in the non-blocking position, which allows the exit device to operate conventionally.

FIG. 2 shows the exit device 10 looking upward from the bottom of FIG. 1 towards the mounting rail 16 and pushbar 14. Parts of the mounting rail and pushbar have been cut away to show the internal mechanism more clearly. The latch, which may be any type of conventional latch mechanism is not shown, but it will be understood that the inward motion of the pushbar operates the latch 12.

The pushbar 14 moves inwards by means of a parallelogram linkage formed by connecting arms 26 and 28, the mounting rail 16 and the pushbar 14. Connecting arm 26 is pivotally connected to the mounting rail 16 via pivot 30 and to the pushbar by pivot 32. Connecting arm 28 is pivotally connected to the mounting rail 16 with pivot 34 and to the pushbar by pivot 36. Torsion springs 38 and 40 provide the spring force that biases the parallelogram linkage to hold the pushbar 14 away from the exit door 18 and the mounting rail 16.

In normal operation, when sufficient force is applied to the pushbar 14, the pushbar will pivot inwards towards the mounting rail 16 as the connecting arms 26 and 28 rotate about their respective pivots. The pushbar will remain parallel to the mounting rail and the torsion springs 38 and 40 will be compressed. The inward motion of the pushbar will actuate the latch mechanism 12 to open the door 18. When the horizontal force is released, torsion springs 38 and 40 will rotate the connecting arms 26, 28 to move the pivots 32, 36 away from the mounting rail back to the position seen in FIG. 2.

FIG. 1 shows the interior side of exit door 18 where the exit device 10 is mounted. As previously described, during a high energy impact to the exterior side of door 18, such as the impact delivered when tornado debris hits the exterior of the door, the door 18 and the mounting rail 16 can move towards the pushbar 14, which remains stationary due to inertia. Alternatively, the pushbar may rebound towards the mounting rail during the impact event. In either case, however, the initial force against the exterior of the door is applied in the direction indicated by arrow 42 in FIG. 2 and the relative motion of the mounting rail 16 and the pushbar 14 is to compress the torsion springs 38, 40.

In prior art designs addressing the tornado impact problem, the strength of the springs corresponding to torsion springs 38 and 40 is increased to prevent this relative motion during the impact event. This solution, however, has the major disadvantage that the exit device becomes difficult to operate as the excessively strong springs must be compressed every time the exit device is used. In the present design, the torsion springs are of a conventional strength—strong enough to ensure that the pushbar will reliably return to the position seen in FIG. 2 when no force is applied to the pushbar. The torsion springs do not need to be so strong that they prevent motion of the pushbar towards the mounting rail during the impact event.

The present invention addresses this problem by providing a blocking mechanism including a blocking arm 44, a pivot 46 and a blocking arm spring 48. The blocking arm is pivotally attached to the mounting rail 16 by the pivot 46 and lightly held against the mounting rail 16 by the blocking arm spring 48, which is preferably a torsion spring. The pivot 46 allows the blocking arm 44 to move between the non-blocking retracted position seen in FIG. 2, where the head 50 of the blocking arm is held against the mounting rail 16 by torsion spring 48, and the blocking extended position seen in FIG. 3 where the head 50 of the blocking arm 44 has moved into interfering and blocking contact with stop 52 on the connecting arm 26.

As can be seen in FIG. 2, in order for the door to open, the parallelogram linkage of the exit device requires that the connecting arm 26 pivot to move the stop 52 on the connecting arm 26 in the direction shown by arrow 54. Stop 52 moves in an arc around pivot 30. When tornado or other high energy debris impacts the door from the direction indicated by arrow 42, energy is transferred from the impacting debris to the door 18 and from there to the mounting rail 16.

This transfer of energy continues and transfers energy to the blocking arm 44. The torsion spring 48 is initially holding the head 50 of the blocking arm 44 against the mounting rail 16 as in FIG. 2. Because the opposite end of the blocking arm 44 is connected to the mounting rail 16 by pivot 46, the impact energy transferred to the blocking arm 44 causes the blocking arm to swing outward away from the mounting rail 16 to the blocking position seen in FIG. 3.

This outward swing of the blocking arm 44 occurs extremely rapidly—before the pushbar 14 and the mounting rail can move significantly towards each other to open the door. The torsion spring 48 is just strong enough to hold the blocking arm 44 against the mounting rail 16, but not so strong that it prevents the outward swing of the blocking arm to the position in FIG. 3. It should be noted that pivot 46 is vertical and the weight of the blocking arm 44 is not be supported by the torsion spring 48.

Figure 3:
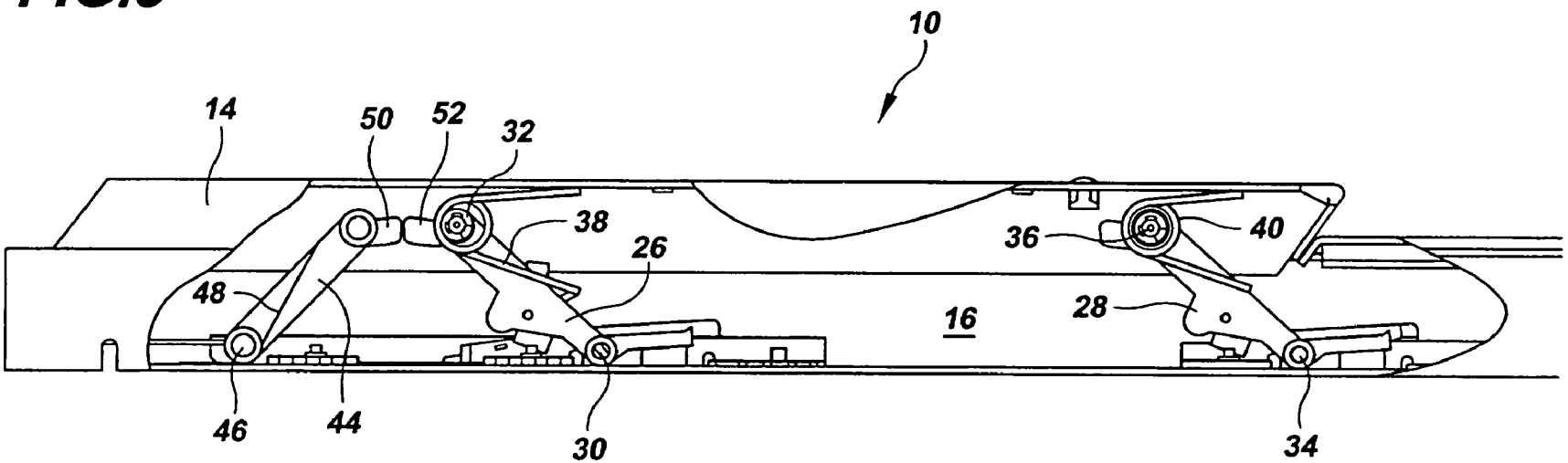
FIG. 3 is a partial view of the invention as illustrated in FIG. 2 except that the blocking mechanism is shown in the blocking position. In this position, which is reached shortly after a high energy impact against the exterior of the exit door, the pushbar cannot move towards the mounting rail due to the action of the blocking mechanism.

As the blocking arm 44 swings away from the door 18 and the mounting rail 16, head 50 on the blocking arm moves directly into the blocking position of FIG. 3 to prevent stop 52 from moving in the direction of arrow 54. This blocks the opening motion of the pushbar during the initial impact and during any rebounding motion during the remainder of the impact event. The blocking arm acts to prevent the pushbar from operating the latch mechanism 12 by preventing motion of the pushbar towards the mounting rail.

The motion of the blocking arm is sufficiently rapid that it reaches the blocking position before the distance between the pushbar and the mounting rail can decrease significantly. It remains in this blocking position during any rebounding motion of the pushbar or door.

Once the impact event is over, the torsion spring 48 returns the blocking arm 44 to the position seen in FIG. 2. The exit device then functions normally and the door 18 may be opened. This design, which functions through energy transfer from the door to the blocking mechanism, provides a temporary lock for the exit device only during the brief period of the impact event. It has no negative impact on normal day-to-day operation of the exit device as will occur when the strength of the main biasing springs is increased as in the prior art.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. An exit device comprising:

a latch;

a mounting rail for mounting to an inner surface of a door;

a pushbar mounted for motion relative to the mounting rail between an inward position towards the mounting rail and an outward position away from the mounting rail, the pushbar operating the latch when moved to the inward position;

at least one connecting arm having a connecting arm first end pivotally mounted to the mounting rail and an opposed connecting arm second end pivotally attached to the pushbar for guiding the pushbar when the pushbar is moved between the inward and the outward positions, a first stop member extends from the at least one connecting arm second end;

at least one pushbar biasing spring biasing the pushbar towards the outward position; and a blocking arm having a blocking arm first end pivotally mounted to the mounting rail, an arm body and an opposite blocking arm second end, a second stop member extends from the blocking arm second end, the blocking arm is movable between a blocking position and a non-blocking position, the blocking arm being biased towards the non-blocking position into contact with the mounting rail and the arm body and the second blocking arm end moving outwards and away from the mounting rail into the blocking position as a result of energy transfer to the blocking arm such that the second stop member contacts the first stop member to prevent motion of the pushbar towards the mounting rail during a high-energy impact against an outer surface of the door.

2. The according to claim 1 wherein the blocking arm is biased towards the non-blocking position into contact with the mounting rail by a blocking arm spring.

3. The exit device according to claim 2 wherein the blocking arm spring provides a biasing force sufficiently strong to hold the blocking arm in contact with the mounting rail in the non-blocking position, and sufficiently weak to allow the blocking arm to move to the blocking position away from the mounting rail during a high-energy impact against the door.

4. The exit device according to claim 2 wherein the blocking arm spring is a torsion spring.

5. The exit device according to claim 1 further including another connecting arm pivotally mounted between the pushbar and the mounting rail, whereby the at least one connecting arm and the another connecting arm form a pair of connecting arms acting as a parallelogram linkage with the pushbar and the mounting rail.

6. The exit device according to claim 1 wherein the blocking arm moves on a pivot, the pivot defining a substantially vertical axis for substantially horizontal motion of the blocking arm between the non-blocking and the blocking positions.

7. The exit device according to claim 1 wherein the high-energy impact against the door defines an impact direction and the blocking arm moves in the same direction as the impact direction when moving from the non-blocking position to the blocking position.

8. An exit device comprising:

a latch;

a mounting rail for mounting to an inner surface of a door;

a pair of connecting arms, each connecting arm having first and second ends, the first ends of the connecting arms being pivotally mounted to the mounting rail and at least one of the pair of connecting arms having a first stop member extending from its corresponding second end;

a pushbar connected to the second ends of the connecting arms to form a parallelogram linkage with the mounting rail and the pushbar, the pushbar moving between an inward position towards the mounting rail and an outward position away from the mounting rail, and the pushbar operating the latch when moved to the inward position;

at least one pushbar biasing spring biasing the parallelogram linkage to hold the pushbar towards the outward position; and a blocking mechanism comprising a blocking arm, a blocking arm spring and a pivot, the blocking arm having a blocking arm first end pivotally connected to the mounting rail, an arm body and an opposite blocking arm second end, a second stop member extends from the blocking arm second end, the blocking arm is movable between a blocking position and a non-blocking position, the blocking arm being biased towards the non-blocking position and into contact with the mounting rail by the blocking arm spring and the arm body and the second blocking arm end moving outwards and away from the mounting rail into the blocking position as a result of energy transfer to the blocking arm such that the second stop member contacts the first stop member of the at least one of the pair of connecting arms to prevent motion of the pushbar towards the mounting rail during a high-energy impact against the door, the blocking arm spring returning the blocking arm to the non-blocking position after the high energy impact.

9. The exit device according to claim 8 wherein the pivot provides a substantially vertical axis and the blocking arm moves substantially horizontally between the non-blocking and the blocking positions.

* * * * *